US006589891B1

(12) United States Patent
Rast

(10) Patent No.: US 6,589,891 B1
(45) Date of Patent: Jul. 8, 2003

(54) ABRASION RESISTANT CONFORMAL BEADED-MATRIX FOR USE IN SAFETY GARMENTS

(75) Inventor: Rodger H. Rast, Rancho Cordova, CA (US)

(73) Assignee: Rastar Corporation, Gold River, CA (US)

( * ) Notice: Subject to any disclaimer, the term of this patent is extended or adjusted under 35 U.S.C. 154(b) by 192 days.

(21) Appl. No.: 09/718,735

(22) Filed: Nov. 22, 2000

Related U.S. Application Data

(60) Provisional application No. 60/167,593, filed on Nov. 26, 1999.

(51) Int. Cl.[7] ..... B32B 3/10; A41D 13/15

(52) U.S. Cl. ..... 442/1; 428/101; 428/105; 428/107; 428/156; 428/112; 428/172; 428/131; 428/134; 428/908.8; 428/137; 2/455; 2/456

(58) Field of Search ..... 428/112, 172, 428/178, 101, 137, 156, 161, 173, 174, 131, 908.8, 105, 107, 134; 2/455, 456; 442/1

(56) References Cited

U.S. PATENT DOCUMENTS

| | | | | | |
|---|---|---|---|---|---|
| 3,930,667 | A | | 1/1976 | Osuchowski | |
| 4,017,906 | A | | 4/1977 | Bochynsky | |
| 4,059,852 | A | | 11/1977 | Crane | |
| 4,179,752 | A | | 12/1979 | Fackelmann | |
| 4,422,183 | A | | 12/1983 | Landi | |
| 4,560,185 | A | | 12/1985 | Seidl | |
| 4,639,944 | A | | 2/1987 | Lashley | |
| 4,685,151 | A | | 8/1987 | Kincheloe | |
| 4,722,099 | A | | 2/1988 | Kratz | |
| 4,810,559 | A | * | 3/1989 | Fortier et al. | 156/232 |
| 4,825,469 | A | | 5/1989 | Kinchloe | |
| 4,829,787 | A | * | 5/1989 | Yoda | 63/3 |
| 4,923,728 | A | | 5/1990 | Snedeker | |
| 5,110,661 | A | * | 5/1992 | Groves | 2/2.5 |
| 5,113,526 | A | | 5/1992 | Wang | |
| 5,210,877 | A | | 5/1993 | Newman | |
| 5,292,255 | A | * | 3/1994 | Goldwasser | 434/81 |
| 5,349,893 | A | | 9/1994 | Dunn | |
| 5,361,410 | A | | 11/1994 | Sigl | |
| 5,364,679 | A | | 11/1994 | Groves | |
| 5,382,052 | A | * | 1/1995 | Tarng | 280/11.27 |
| 5,398,391 | A | * | 3/1995 | Yokochi | 24/116 A |
| 5,514,457 | A | | 5/1996 | Fels et al. | |
| 5,535,446 | A | | 7/1996 | Pusic | |
| 5,592,835 | A | * | 1/1997 | Herr | 63/21 |
| 5,649,328 | A | | 7/1997 | Martin | |
| 5,652,031 | A | * | 7/1997 | Commanda | 428/13 |

(List continued on next page.)

FOREIGN PATENT DOCUMENTS

| | | | | |
|---|---|---|---|---|
| DE | 29821249 | * | 5/1999 | B60R/19/00 |
| GB | 2285222 | * | 7/1995 | A61N/2/08 |
| KR | 2001048524 A | * | 6/2001 | D06Q/1/10 |

*Primary Examiner*—Cheryl A. Juska
*Assistant Examiner*—Lynda Salvatore
(74) *Attorney, Agent, or Firm*—Rodger H. Rast

(57) ABSTRACT

An abrasion resistant garment and method of producing same. A garment that is highly ventilated while providing abrasion protection for a wearer during a slide, as for instance that may occur during a fall from a motorcycle. A material is produced wherein abrasion-resistant, low sliding friction, beads are held within a matrix of high-tensile strength, abrasion-resistant, cords. The beaded matrix within the garment can be augmented with layers to form a lining and exterior layers to enhance visibility. The force of a sliding rider is retained over the beaded matrix, away from the road surface. Under abrasive sliding friction, the beads additionally rotate to an extent which tightens the cord matrix and thereby helps constrain the skin surface of the wearer from making contact with the roadway surface.

35 Claims, 8 Drawing Sheets

U.S. PATENT DOCUMENTS 5,675,988 A * 10/1997 Ignatowski ..... 351/52
5,729,832 A 3/1998 Grilliot
5,738,925 A * 4/1998 Chaput ..... 2/2.5
5,746,442 A 5/1998 Hoyaukin
5,774,891 A 7/1998 Boyer
5,887,453 A 3/1999 Woods
5,918,319 A * 7/1999 Baxter ..... 2/22
5,993,377 A * 11/1999 Hartwig ..... 600/38
6,241,572 B1 * 6/2001 Braginsky ..... 434/211

* cited by examiner

ABRASION RESISTANT CONFORMAL BEADED-MATRIX FOR USE IN SAFETY GARMENTS

This application claims priority from U.S. provisional application Ser. No. 60/167,593 filed on Nov. 26, 1999 by the same title.

BACKGROUND OF THE INVENTION

1. Field of the Invention

The present invention relates generally to the manufacture of abrasion-resistant safety garments, and more particularly to a conformal-beaded matrix which may be incorporated within garments to protect the wearer from abrasion.

2. Background of the Description

Various forms of safety garments have been created for use in sports such as motorcycling, bicycling, skating, skateboarding. Many of these garments incorporate impact absorbing areas and abrasion resistant materials which improve wearer safety. The protection offered by these safety garments fall into two main categories: impact protection and abrasion protection. Padded areas, often within resilient cups that may be constructed of materials such as Temperfoam™, are often sewn into garments over impact-sensitive areas, such as over the knees, elbows, shoulders, ankles, and even over the spine. These impact absorbing sections are often referred to as "body armor". Densely woven materials, generally provided in layers, are used within these safety garments for preventing abrasion over the remaining fleshy areas of the user. Traditionally one of the best materials for these safety garments has been thick leather (i.e. over 1.5 mm), as it provides abrasion resistance many times greater than traditional cloth materials. Newer materials such as ballistic nylon, Cordura™, Gortex™, Kevlar™, along with armor sections, are being incorporated within otherwise traditionally constructed cloth garments in order to increase their abrasion resistance. These garments rely on the use of layers of dense durable abrasion resistant cloth materials to protect the wearer.

Often minor abrasions are referred to as "road rash" wherein a slowly moving body contacts a roadway surface at a speed of under 15–20 mph. However in sports such as motorcycle riding, a fall at even moderate speed on a roadway surface can result in severe abrasions; whereby not only the skin is abraded away, but significant amounts of flesh, muscle, and bone can be similarly removed. Even moderate abrasion wounds are painful and slow healing. Severe abrasion wounds can result in a significant blood loss, an infection hazard, a likelihood of permanent disfigurement, and even death.

Everyday clothing provides insignificant levels of abrasion resistance, such as to a motorcycle rider falling on a roadway. In Australia in 1982, the Royal Brisbane Hospital Burn Unit completed a 13½ year study of motorcycle burn injuries wherein 29% of the burn unit victims were road abrasion burns with 46% experiencing the burns to both upper and lower extremities. Of these the median hospital stay was 8 days, but ranged up to 186 days. It was concluded that proper safety clothing would have prevented all of these road abrasion burns. Similar studies have been conducted in England, Germany and other countries with similar results.

Insurance industry and government committees have been looking closely into regulations directed at safety garments. At this time Germany is considering compulsory clothing standards which require motorcycle riders to wear certified safety garments, while the British Standards Institute of the British government is drafting standards for protective clothing for motorcycle riders.

As can be seen, therefore, abrasion-resistant protective clothing should be worn when one is involved an any high speed activity where one is otherwise unprotected from abrasion as a result of a fall. However, the use of protective clothing is often ignored, even though equipment currently exists which can largely protect riders from impact and abrasion injuries. Part of the lack of acceptance of current safety garments may lie in the numerous drawbacks that are inherent in the designs which limit their proper habitual use.

There are generally two principle forms of safety garments available for sports such as motorcycle riding; the first category is leathers, while the second is cloth type garments. Thick leather provides a good measure of protection and is favored by the majority of competitive riders. Its thickness and durability often requires that only a single layer is required to prevent abrasion. However the leather does not stretch nor does it allow air-flow to reach the wearer. Protection in the, many current cloth-type safety garments is provided by means similar to those used within ballistic protection gear, such as so called "bullet proof vests"; wherein a tightly closed material structure is created through which no objects can incur. Layers of densely woven Kevlar™ and carbon fibers have replaced steel chain-mail type construction in these protection suits. Within an abrasion resistant garment, numerous layers of material are utilized to provide redundancy as a layer wears through during a fall, and to provide thermal insulation. To further enhance protection against abrasion, more ballistic armor techniques have been considered, such as covering the exterior of the garment with closely spaced platelets. Within ballistic protection suits the platelets are intended to prevent ballistic incursion, but in this case have been considered to prevent roadway incursion. However, it will be appreciated that such approaches lead to the creation of a heavy garment that is substantially covered with anti-ballistic material. Opening up platelet spacing then leads not only to a garment that tears on impact, but one in which the friction forces rotate platelets, platelet halves, or platelet fragments, against the skin of the wearer inflicting additional injury. In general, abrasion resistant clothing follows the teachings of ballistic protection to provide abrasion protection.

Unfortunately, both the leather and cloth designs, when promulgated as abrasion safety garments, restrict air-flow and consequently when worn in warm to hot weather are at best uncomfortable, and may in fact be unwearable, due to the high risk of hyperthermia. Thick garments such as these allow insignificant amounts of air to flow and thereby pose a dangerous hyperthermia risk as body temperatures can soar. It is not surprising that a large percentage of safety-conscious riders don't ride when it gets warm out, . . . while others ride dangerous underprotected with street clothing. Clothing manufacturers have worked to provide various forms of venting for conventional safety garments, however, venting is unable to compensate for the bulk of layers of tightly woven material surrounding the wearer, and vents are of only minor aid when the wearer is stationary. To fully appreciate the situation, it should also be remembered that in the case of a motorcycle rider, the rider is seated above an engine operating at high temperature, the heat from which rises to envelop the rider.

Accordingly there is a need for abrasion resistant safety garments that can be constructed to minimally restrict ventilation of the wearer. The abrasion resistant conformal beaded-matrix in accordance with the present invention satisfies that need, as well as others, and overcomes deficiencies in previously known techniques.

BRIEF SUMMARY OF THE INVENTION

The present invention is an abrasion resistant garment and method of garment construction that employs round beads held within a two-dimensional open matrix of abrasion-resistant cords. Abrasion resistant beads with low levels of abrasive friction are attached within a crossing matrix of abrasion resistant cords. Constructed within a garment, the bead matrix allows a high degree of ventilation as it covers only a small percentage of skin surface; yet it can provide high levels of abrasion resistance to enhance the safety of sports such as motorcycle riding.

Within the current invention it has been recognized that abrasion resistance is not an analogous problem to that of ballistic protection. Presently, abrasion resistant garments solve the abrasion problem at a micro-level wherein incursion through the fabric is considered throughout the span of fabric. Therefore, the fabric must be of a substantially uniform nature wherein no portions of the skin are to be subject to surfacial contact, being held apart from the road surface by a series of layers. It should be noted that these garments modeled on ballistic principles do provide a level of ballistic (puncture) resistance, however, puncture-type injuries are not a primary source of injury during the majority of incidents. The current invention has eschewed the approach taken in ballistic protection garments and adopted a macro-level approach to the reduction of abrasion, whereby the pliable skin is treated as a integral surface as opposed to a collection of singularities. Within the invention, the skin of the wearer is held off of the pavement surface by abrasion-resistive beads periodically placed within an open matrix. Air flowing between the skin and surface insulate the skin of the wearer from the abrasive surface. The abrasion between the garment and the road surface takes place on the exterior of protruding beads while a large percentage of the skin is not covered by bead, yet is still protected by being retained within the matrix of supporting cords which span between the beads to thereby support the fleshy areas.

The following is an example that may aid visualization of this force distribution concept. Many people have watched in amazement as eastern mystics lie down on a bed of sharp nails and then rise again unscathed. These nails are sharp, and quite obviously any one of these nails can penetrate the skin. However when the force of the body is distributed across a number of these projections the force at each projection is insufficient to cause incursion of the skin surface by any one nail. The person laying down does not need a bullet proof vest (micro-level concept) to prevent a nail from injuring them, they only need to distribute the forces being applied (macro-level concept). The method according to the invention isolates abrasive forces at a series of bead contact points between the wearer and the roadway surface under sliding contact. In similar manner to the "bed of nails", the force across the beaded matrix is thereby distributed. Unlike the bed of nails, the wearer need not be careful of the rate at which the pressure is applied over the matrix, as the shape of each bead supports increasing loads the further it is depressed against the skin.

Each bead within the cord matrix is formed of a material which provides a low sliding resistance when contacting the road surface. These beads extending from the skin's surface bear the majority of the pressure from the rider. The conformal matrix is preferably constructed with integral elastic within the cords of the matrix which retain the beads near the skin surface, and which are capable of only limited stretch under frictional load. An important safety factor within the material occurs under abrasive friction, whereupon the beads rotate to tighten the attached matrix of cords to suspend the skin above the roadway surface between separated bead "pillars". The beads are configured with limited attachment points, preferably four to six, which retain them within the cord matrix while facilitating bead rotation. The beads have a substantially round surface in either one or two dimensions, and may rotate under urging such that side areas of the bead are exposed to the abrading surface. Preferably the beads are configured as either spheres, or oval cylinders. The beads are therefore provided with limited rotation, while they simultaneously take up the slack in the cord matrix to properly retain and suspend the fleshy portions of the wearers skin riding above the beads.

In constructing a safety garment, it is preferably that the conformal beaded matrix be interrupted over the boney areas such as knees, shoulders, elbows, ankles, and spine to incorporate shock absorbing structures, such as body armor sections of conventional construction. It will be appreciated that although the beaded matrix provides a high degree of abrasion protection while providing for air-flow, it provides very limited impact resistance. Although the beaded matrix could be created as a single layer garment, it is preferable that the beaded matrix be sandwiched between layers of thin open-weave breathable cloth to improve appearance and for the incorporation of reflective material. The beaded matrix can be incorporated in garments constructed for any season of use depending on the number and composition of the layers employed.

This method of providing abrasion safety departs from that of prior garments in a number of respects. The open nature of the material allows for very high levels of ventilation to be provided in a garment without compromising safety from road abrasion. Garments produced therefrom can be worn comfortably on even the hottest of days. The present invention should have lower weight, increased airflow, and added safety when compared with conventional safety garments modeled after ballistic suits, or ballistic suits which consider the use of exterior platelets. Expanding the distance between the tiny plates attached over a conventional ballistic style safety garment to lighten the suit and provide for airflow does not yield similar results as the present invention and may pose a safety risk. In an abrasive sliding situation the edges of these plates catch the ground and rotate, this increases garment tearing while the opposing exposed edges of the plate are driven into the wearer's flesh. Such a plate can easily be driven into a near-surface bone, such as a shin-bone, to cause a fracture. Providing space between surface platelets, therefore, allows the edges to become vulnerable to catching the ground. As an edge catches, the cloth surrounding it is in contact with the surface of the ground, caught between the hard edge of the small plate and the hard road surface, such that the two in concert can grind through even abrasive resistant cloth. In addition the conventional construction of platelets have employed metals or ceramics, which although durable, create high levels of interface friction between the garment and the roadway surface. The high degree of friction causes high rotational torque on the sliding rider's body, thus increasing the extent of tumbling related injuries.

Within the beaded matrix of the invention, each bead retains a round portion against the skin and a similar portion which is in contact with the ground during a slide, there is no transition region, such as the edge of a plate, during rotation of the bead element. It will be appreciated that the beads retained in the matrix may be of differing sizes in accord with the level of abrasive forces which may exist over that area. For example, the skin surfaces of the inner thighs, between the legs, are subject to far less abrasive risk than the anterior portions near the hips. In some areas, such as the crotch or under the arms, the inclusion of beads within the matrix may be forgone altogether. The rounded outer surface areas of each bead slides on the pavement surface easily without catching, and the inner surface areas of each bead make smooth contact with the wearers skin, applying smooth pressure gradients around the contact points of the beads, without projecting edge regions into the skin or bone of the wearer. The soft abrasion resistant beads, therefore, can partially rotate while maintaining a smoothly contoured exterior which is not prone to catching the surface of the road, and a smoothly contoured interior which will not lacerate the rider. In addition, the rotation of a section of beads enhances the safety of the garment as it causes the underlying matrix to tighten up to hold the skin away from the road surface more effectively. The use of a conventional cloth material to retain the beads is not preferred as the material then divides the bead into a lower and upper half and creates a transition region about the annular periphery where the cloth exits the bead. A conventional cloth material substantially inhibits bead rotation that provides the increased skin retention forces, while the continuous span of cloth itself then becomes subject to tearing. In contrast, the cord material of the matrix forms a very open structure, which allows each cord within the matrix to be configured with even large diameter cords, for instance 1/16 to 1/8 inch, without significantly reducing airflow and flexibility, or unduly increasing cost. The large diameter of the cord material can be produced with a very high resistance to abrasive wear-through. Also the beads, being of a soft material, do not act in concert with the road surface to abrade the surrounding matrix. Moving against a surface of skin under compressive oscillating friction, the beads should also induce lower levels of friction heating against the skin surface when compared to cloth.

An object of the invention is to provide abrasion-resistant garments that can be constructed to provide improved ventilation.

Another object of the invention is to provide a material for the abrasion-resistant garment in which only a small surface of the wearers skin need be covered with the closed portions of material comprising the garment.

Another object of the invention is to create a method of providing abrasion resistance within a garment that may additionally employ protective armor sections over boney area such as the knees, elbows, shoulders, ankles, and spine.

Another object of the invention is to provide abrasion-resistant garments that can be worn with or without exterior layers for retaining warmth.

Another object of the invention is to provide abrasion-resistant garments that do not impose high rotational torque forces on fallen riders which can lead to additional injury.

Another object of the invention is to provide abrasion-resistant garments wherein the frictional forces on the exterior beads during a slide tighten up the garment to restrict contact of integument with the pavement surface.

Another object of the invention is to provide a method of obtaining abrasion resistance that does not rely on the use of a continuous span of material coverage.

Another object of the invention is to allow for the creation of abrasion-resistant garments which may be easily manufactured at low cost.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings for illustrative purposes, the present invention is embodied in the apparatus generally shown in FIG. 1 through FIG. 19. It will be appreciated that the apparatus may vary as to configuration and as to details of the parts without departing from the basic concepts as disclosed herein.

Figure 1:
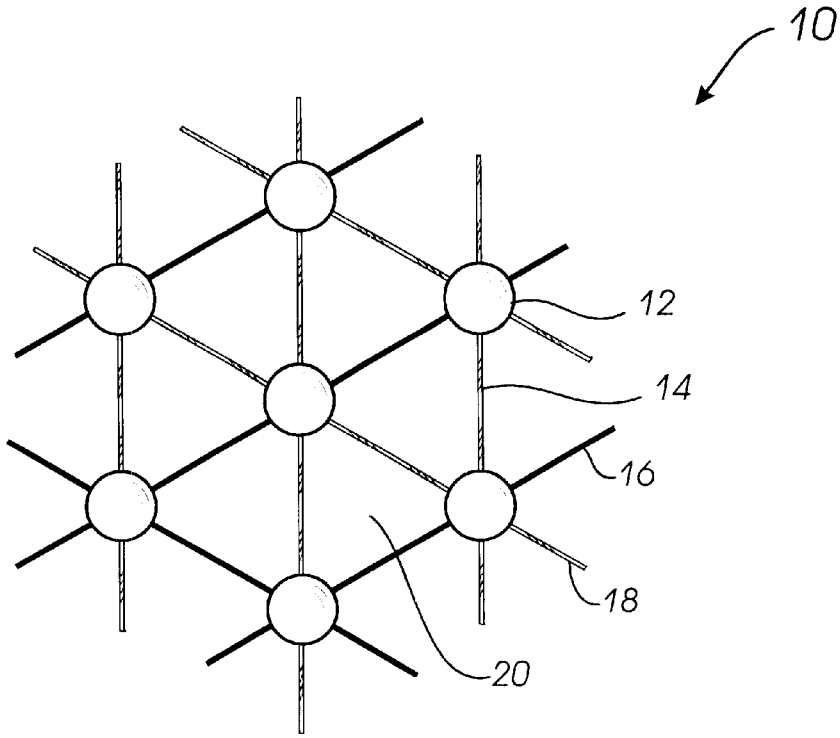
FIG. 1 is a plan view of an abrasion-resistant matrix according to the invention shown with a triangular matrix of cords and abrasion beads retained at each crossing node.

An abrasion-resistant matrix 10 according to the invention is shown in FIG. 1. A series of beads 12 are interconnected in a triangular matrix of cords 14. The beads 12 within this embodiment are preferably manufactured from UHMW-PE (ultra-high-molecular-weight polyethylene) which has three times the abrasion resistance of steel while having low surface friction and providing thermal insulation. Bead size and spacing depend largely on the duty required along with the construction and number of optional layers used with the bead matrix. By way of example and not of limitation, a bead size is described herein as 5 mm in diameter while the corresponding bead to bead spacing is 20 mm. Alternate sizes and spacing can provide for use over various parts within a garment, duty, and construction. Bead size may be varied so that material is conserved in areas wherein less risk of abrasion exists. The cords 14 are so constructed to provide high tensile strength and abrasion resistance, even when directly applied against the abrasive surface under bead rotation. Numerous materials separately or in combination can provide the needed strength. Materials such as Kevlar™ and other aramid or para-aramid fibers, may be incorporated to provide excellent strength and durability. The cords 14 are preferably constructed to provide limited elasticity so that the garment will fit securely during high speed riding. Threads, or bands, of Kevlar™ or other high abrasion-resistant material, can be knitted to form a cord exhibiting limited elastic stretching. Alternately, bands/threads of Kevlar™, or graphite fiber, can be wrapped or woven with another cord or set of knitted or twisted threads. The cord as currently embodied is preferably at least 1.0 mm in diameter. Although smaller diameters can provide adequate strength, they may uncomfortably dig into the skin under high compressive or rotational bead loading which tightens the cord matrix against the skin. It must be understood that other cord compositions may be utilized which will be obvious to one skilled in the art, preferable are those which provide for limited elastic stretching along with high tensile and abrasive resistance.

Figure 2:
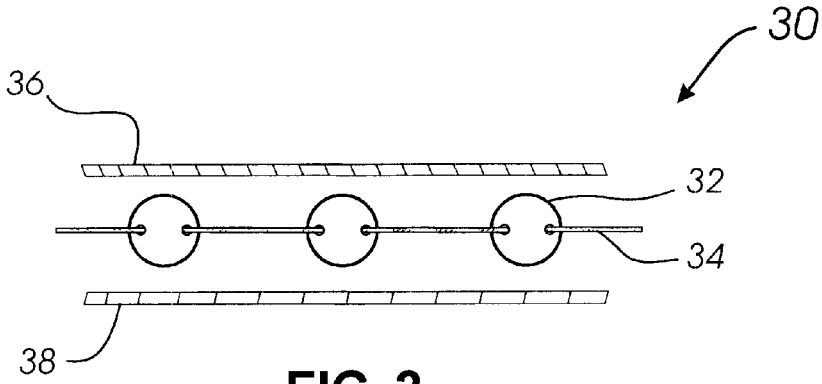
FIG. 2 is a side view of the abrasion-resistant matrix of FIG. 1 shown with optional exterior appearance layer and inner comfort layer.
Figure 3:
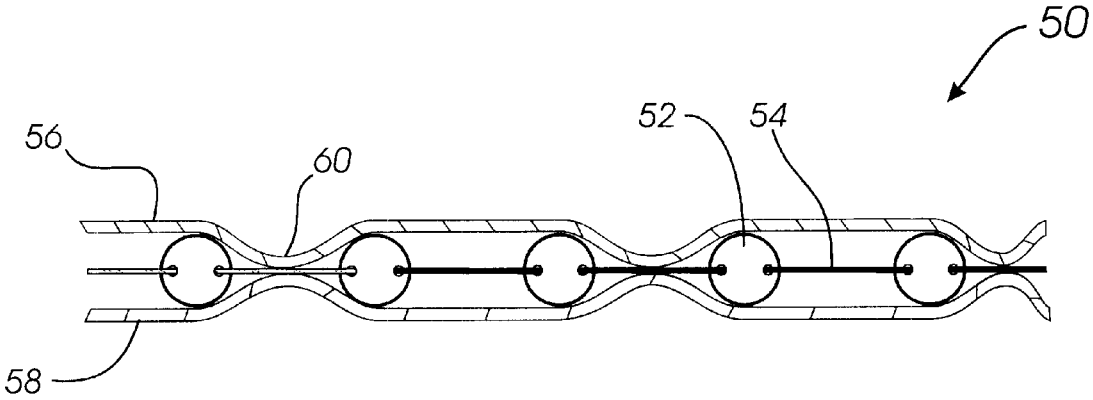
FIG. 3 is a side view of the abrasion-resistant matrix of FIG. 2 shown with quilted stitching retaining inner and outer layers together.

The representative abrasion resistant beaded matrix shown in FIG. 1 can be directly tailored into a garment that preferably includes impact protection at strategic locations. It is anticipated that in general, the beaded matrix will be implemented within additional layers to enhance both comfort and visual appeal. FIG. 2 shows a beaded matrix sandwiched between two layers 30 of cloth. The beads 32 and cords 34 of the beaded matrix are held between an outer layer 36 and an inner layer 38. Composition of the inner and outer layers depends on the duty with which the garment is intended. Although the beaded matrix allows for the construction of safety garments with flow-through ventilation that can be worn comfortably even in the warmest weather, it can also be used within heavy winter weight garments, along with racing suits, motorcross outfits, and a wide variety of other abrasion resistant safety garments. For a very light summer weight garment the outer layer 36 preferably comprises a Cordura™ shell with reinforced ventilation holes. Many fabrics are manufactured for sports that provide strength and ventilation. It will be appreciated that the outer shell need not provide abrasion resistance because the bead matrix prevents any large areas of integument from being abraded on the roadway, or other surface. The inner layer 38 may be of a light cotton liner material that provides a soft and absorbent material against the skin of the wearer. To retain the layers in the proper orientation to one another and to prevent the fabric from flapping in response to air pressure changes, the inner and outer layers are preferably stitched (quilted) to one another as shown 50 in FIG. 3 surrounding beads 52 contained on cords 54. Obviously, the stitching between outer layer 56 and inner layer 58 preferably connects the two layers between the beads 60 through the corded area 54 so the stitching does not need to pass through the thick material of the beads 52.

Figure 4:
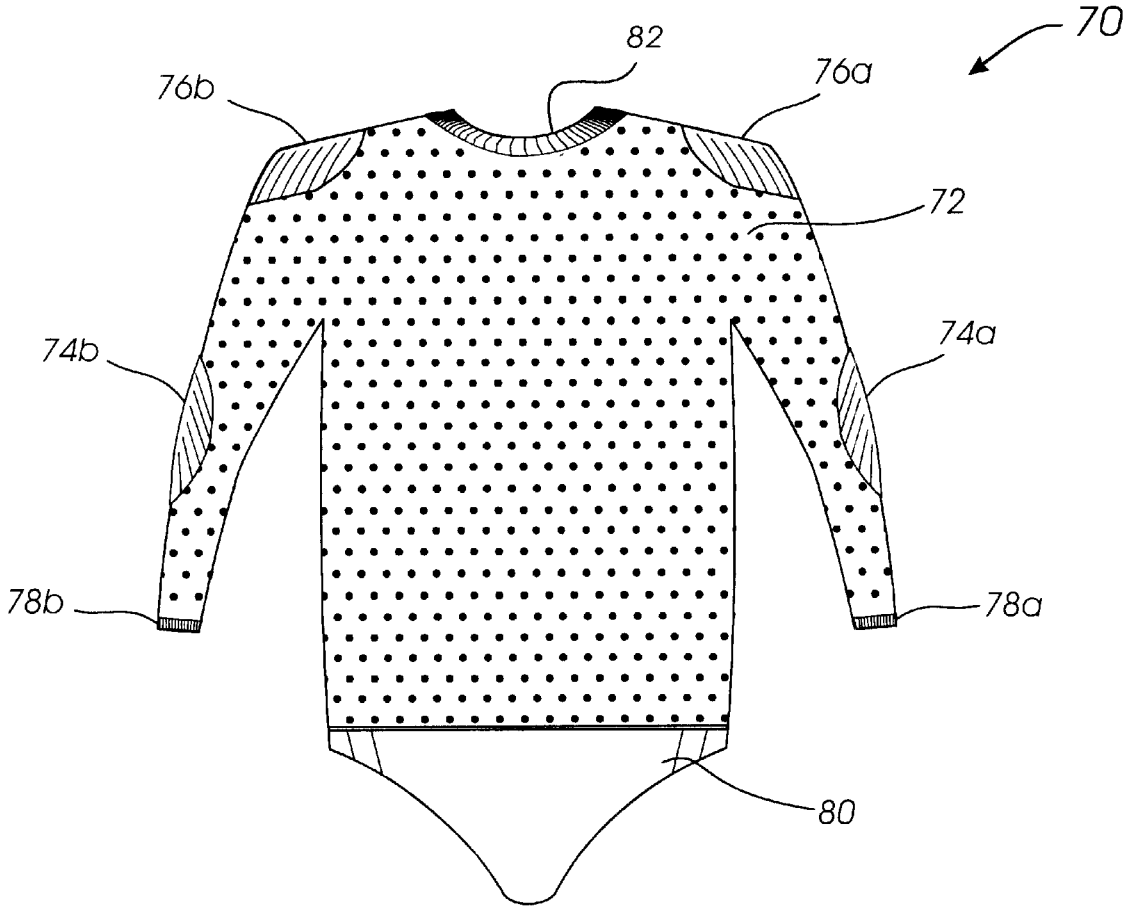
FIG. 4 is a front view of an example torso protection garment constructed from the abrasion-resistant beaded matrix shown with included body armor sections.

FIG. 4 shows an example of a torso protection garment 70 constructed from the abrasion-resistant beaded matrix 72 shown with included body armor sections. The garment is shown for clarity without an outer fabric shell while the cord connecting the beads is not visible in this overall view. It is preferable for such a garment to include a number of additional safety features. Elbow armor 74*a*, 74*b*, and shoulder armor 76*a*, 76*b*, preferably provide hard abrasion-resistant exterior shells with dense foam shock absorbing liner material. The cords of the beaded matrix, sans beads, are preferably sandwiched within the armor pads to assure that the armor is unable to separate from the cord matrix and thereby the remainder of the garment. Alternatively, the matrix of cords may be sewn into or around the armor sections for retaining the garment and armor in place. The ends of the garment terminating at the wrists 78*a*, 78*b* is preferably reinforced and provided with a closure, such as a snap, so that the sleeve is retained over the forearm. During a slide the forearm may contact the ground such that the contact friction attempts to pull the sleeve portion of the garment away from the wrist. It is preferable therefore that the sleeve be retained so that the wrist area does not become exposed to abrasion. A fastener, such as a snap, can be used to narrow the opening at the wrist after the hand has been inserted into the garment; the restricted opening thereby prevents the sleeve from substantial movement. Other alternative means of retaining the sleeve include attachment to a glove, and the use of finger webbing, whereby one or more straps wrap around between the fingers of the hands. An underlining region 80 is provided to retain the torso garment from shifting around the midsection. If the bottom of the torso garment is not retained in some manner then the beaded matrix may shift under sliding force to expose large areas of the skin. The torso garment 70 is preferably attached to a full length trouser garment that contains an abrasion resistant beaded matrix and armor sections. The neck 82 of the garment is reinforced and may be equipped with snaps to prevent gaps around the neck area. A garment may be alternatively fabricated in a coverall style so that the interface between an upper and lower portion does not exist.

Figure 5:
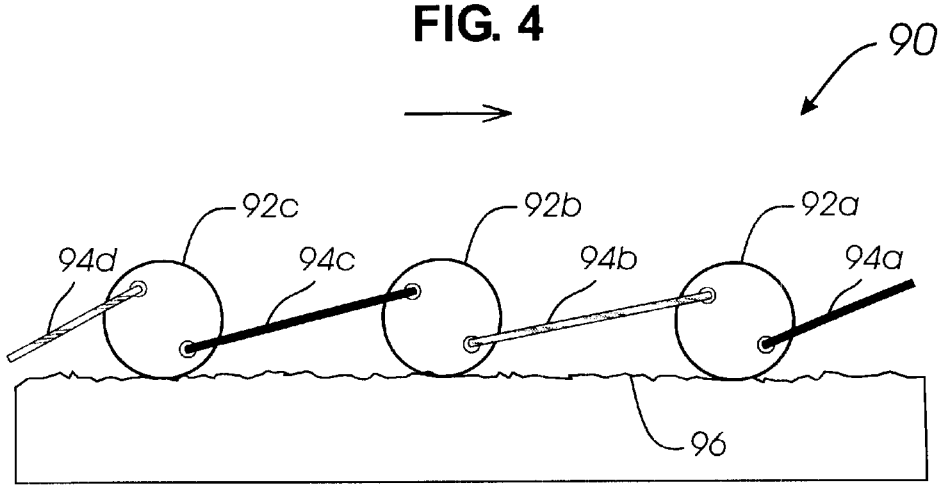
FIG. 5 is a edge view diagram of the abrasion-resistant beads shown in sliding contact with a pavement surface.

In use, this beaded matrix offers a unique mode of protecting the wearer. Referring now to FIG. 5 a series of beads 90 are shown under abrasive contact with an asphalt surface. For clarity, FIG. 5 shows a row of beads in isolation without coverings, other beads or body portions. The skin of the wearer is held above the pavement riding on a beaded surface. Between the beads 92*a* through 92*c* are gaps where no protective material may exist. However, the wearers skin does not contact the asphalt surface 96 due to the matrix of cords 94*a* through 94*d* which retain the skin above the pavement surface. Furthermore, under the sliding friction the beads tend to rotate to cause the cord matrix to tighten within that area of the garment to more securely retain the body area off of the pavement. During a very short interval as a result of an initial high-G impact it may be possible for small portions of the skin to make incidental contact with the ground through the openings in the matrix, but as the force translates to a sliding force then only the weight of the rider should then be held above the beads during the slide. Should such incidental contact occur it would not result in significant injury. It is preferable that a limited stretch fabric be used within an optional lining to provide comfort and to prevent even incidental contact as it provides a trampoline effect between the beads in the matrix. The underside of each bead 92*a* through 92*c* can be easily seen in this view to proffer a smooth surface at the interface with the pavement 96. Smooth transitions with the pavement reduce the chances of the material "catching" the ground. When a material under abrasive sliding contact catches the ground, the forces on the garment drastically increase at that location, since the entire momentum of the rider may be temporarily caught at that one point, whereby the chances of tearing the garment increase and rotational torque forces applied to the sliding body can increase dramatically leading to increase risk of fractures.

Figure 6:
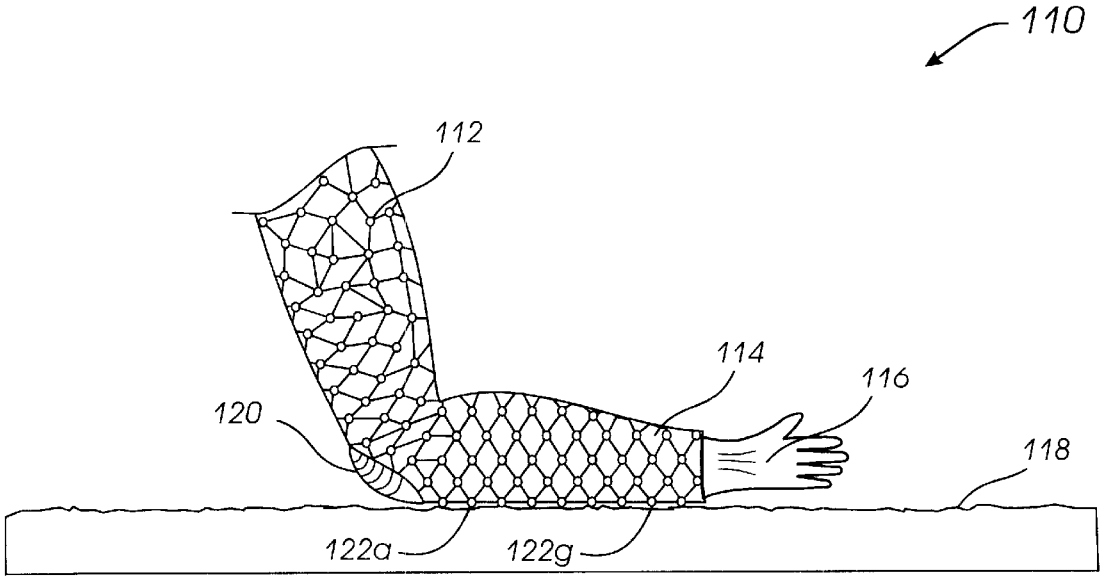
FIG. 6 is a diagram of the arm of a rider wearing the beaded matrix, wherein the rider's arm is in sliding contact with the pavement.

FIG. 6 is a diagram of a rider's arm within the beaded matrix 110 shown in sliding contact with a pavement surface 118. Upper arm 112 and forearm 114 are covered with the abrasive resistant beaded matrix according to the invention while the rider's hand is covered with a glove 116. Protecting the bone of the elbow is shown an armor cup 120 that has a rigid abrasive-resistant exterior and a firmly padded interior. In this view, a row of beads 122*a* through 122*g* can be seen in contact with the pavement surface. As the rider slides they are retained above this platform of abrasive-resistant, but low friction beads. The force of the slide is dissipated within the beads and not the arm of the rider.

Figure 7:
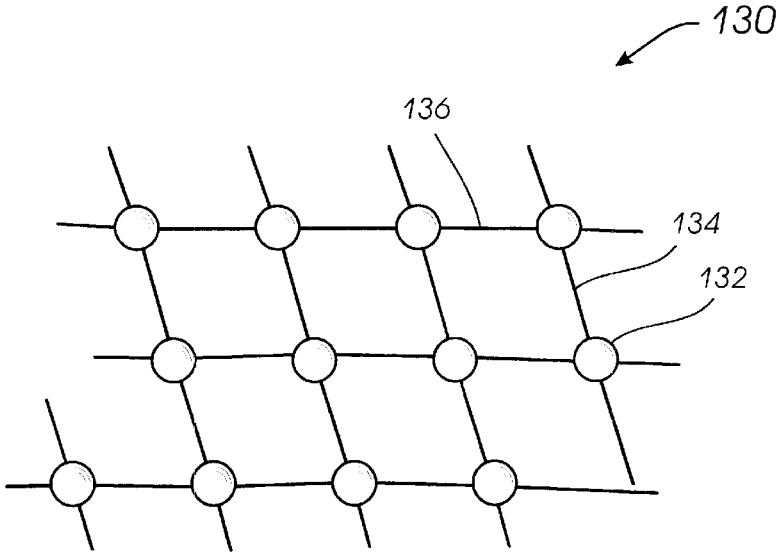
FIG. 7 is a diagram of an alternate trapezoidal beaded matrix according to the invention.

The cord matrix of the invention may be configured in a variety of structures and geometric configurations, such as triangular, square, hexagonal, octagonal, and so forth, depending upon the area of intended use and the application. FIG. 7 is an alternate trapezoidal beaded matrix 130 according to the invention, shown with beads 132, longitudinal cords 134, and vertical cords 136.

Figure 8:
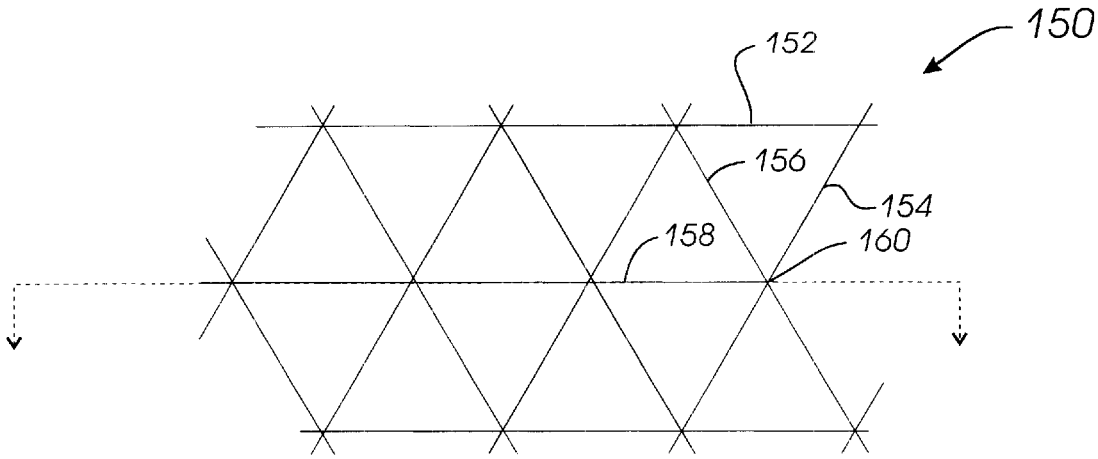
FIG. 8 is a diagram of a series of cords within a triangular matrix prior to attachment of the abrasion-resistant beads.
Figure 9:
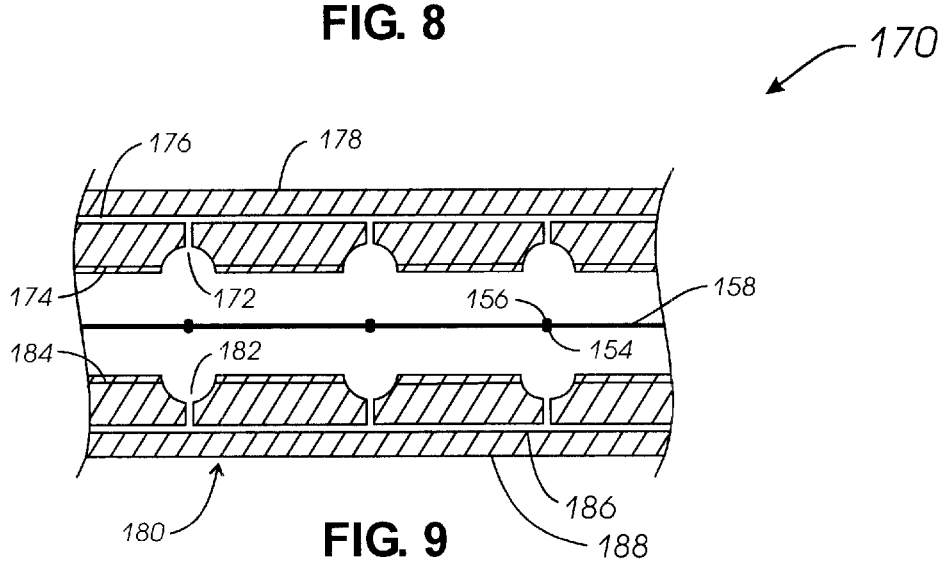
FIG. 9 is a cross section view of a proposed manner of injection forming the beads over the series of cords within the matrix.
Figure 10:
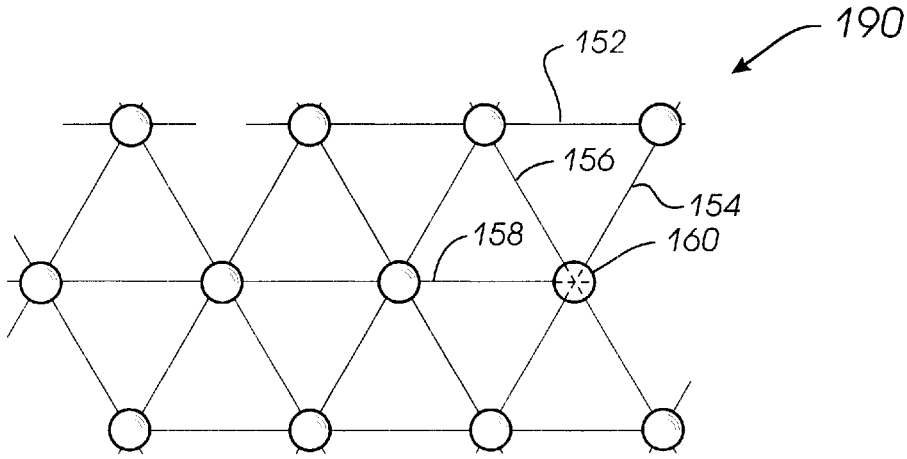
FIG. 10 is a plan view of a completed bead matrix produced by the injection process shown in FIG. 9.

The abrasion resistant garment employing the beaded matrix of the invention can be manufactured in a variety of ways. Individual beads may be integrated, or assembled within the corded matrix, or molded onto a cord matrix as described by FIG. 8 through FIG. 10 which shows a molding process of manufacture. In FIG. 8 a set of high-tensile strength abrasive resistant cords 150 are held in a web configuration between which triangular spaces exist. Cords within a first cord direction 152, a second cord direction 154, and a third cord direction 156 are retained with cross over points 160. A cross-section of the matrix is shown on edge in FIG. 9 with an injection bead molding apparatus 170, closing down on the cord matrix, with bead molds, such as 172 being shown alongside a mating surface 174. The mating surface 174 can attain secure contact with the mating surface 184 of the opposing side of the mold 188 while leaving small necked down channels the cords to pass undamaged between the injection mold heads 178 and 188. Injection sites within each bead mold are fed by a series of passageways 176, 186 through which the molten plastic material may be injected into the closed mold at the site of each bead. The resultant abrasion resistant beaded matrix according to one embodiment of the invention is shown in FIG. 10. Cords with first 152, second 154, and third 156 directions are attached to one another within each rounded bead 160.

Figure 11:
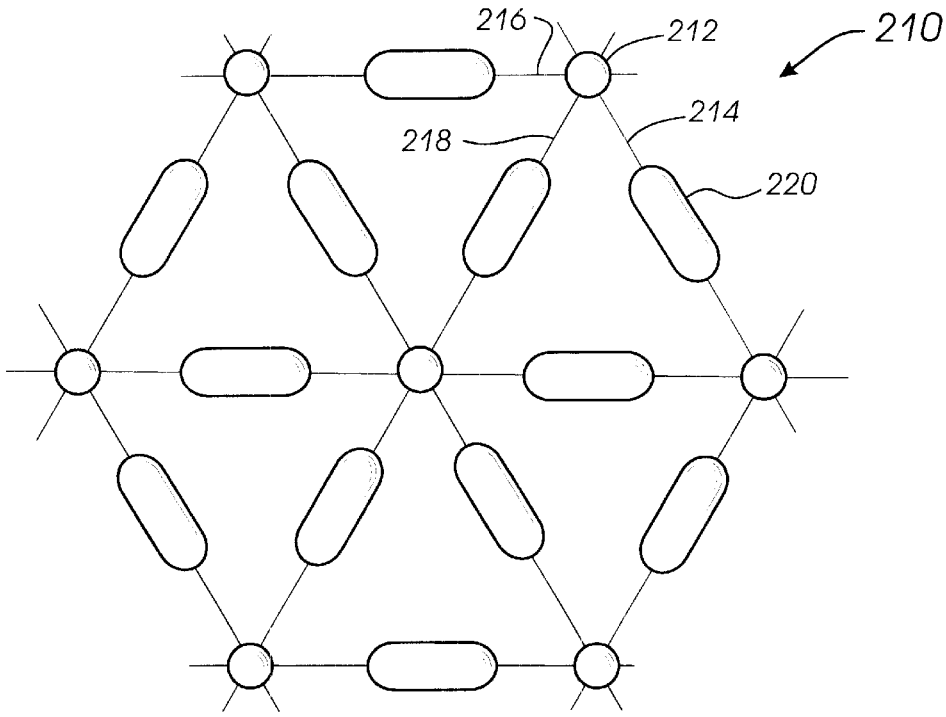
FIG. 11 is a diagram of an alternate embodiment of the beaded matrix wherein additional span beads are attached between the nodal beads within the matrix.

An alternate embodiment of the abrasion resistant beaded matrix structure is shown in FIG. 11. The beaded matrix herein contains cording attached at nodes 212, wherein the cording is in a first 214, second 216, and third 218 direction. Additional span beads 220 are attached between the nodal beads 212 within the matrix. Such arrangement, however, is generally less preferred than the use of spherical beads.

Figure 12:
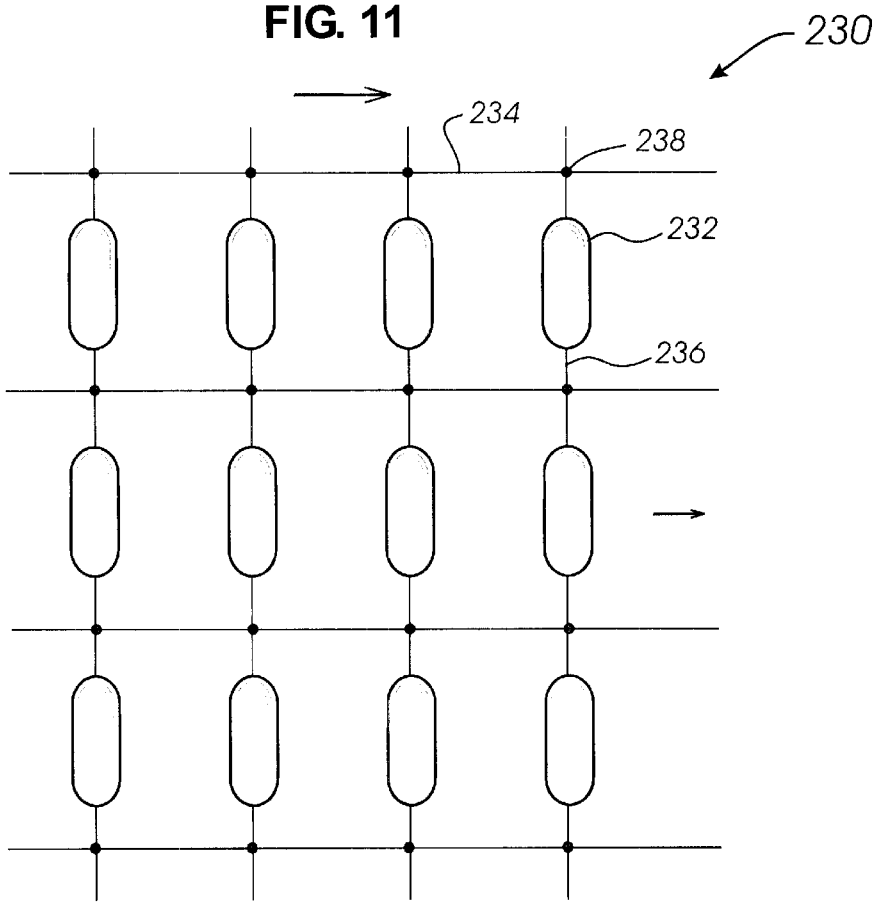
FIG. 12 is a diagram of an alternate embodiment of a non-nodal beaded matrix configured for a particular frictional direction.

An alternate embodiment 230 configured for a particular direction of sliding is shown in FIG. 12. This form of beaded matrix is a non-nodal beaded matrix wherein the beads are all contained on the span cords between nodes. This matrix requires that the cords be retained to one another by a bonding means which may comprise thermal bonding, tying, a material envelope, or adhesives. Again, this is generally less preferred in the majority of applications in relation to the array of spherical beads.

Figure 13:
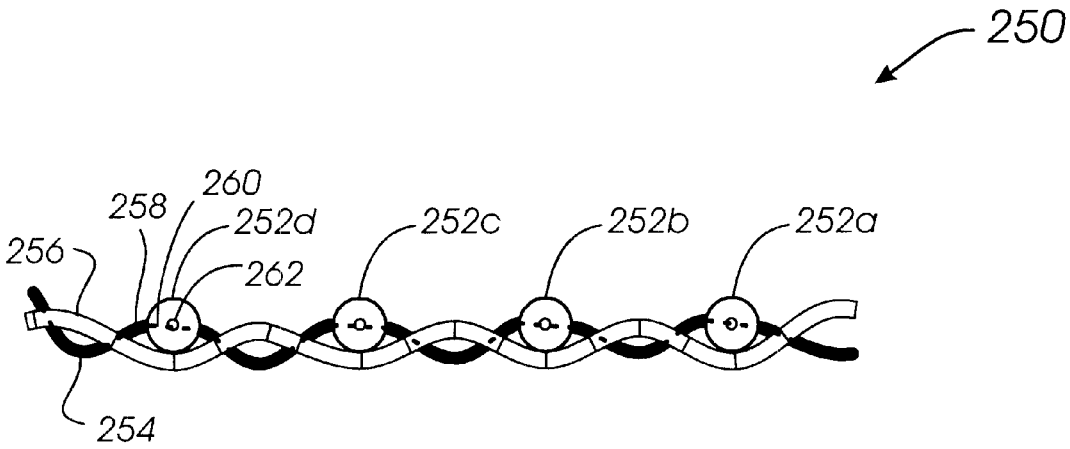
FIG. 13 is a diagram of an alternate manufacturing method wherein the cords of the beaded matrix are threaded through a ventilated cloth layer.

FIG. 13 shows an alternative method of manufacturing the abrasion-resistant beaded matrix 250 of the invention. Beads 252*a* through 252*d* are attached to one another by means of the abrasion-resistant cords 254, which are also threaded through one or more layers of material. The cord 254 is shown entering a bead 252*d* at entry 258 through the width of the bead by tube 260. An aperture 262 is an opening for a cord retaining the bead in the opposing orientation. Again, within this embodiment, rotation of the beads of the matrix during a slide, create constrictive forces on the cord matrix to retain the skin of the wearer off of the surface of the road. In the prior embodiments the beads were molded onto the nodes of the cord matrix which prevented them from moving along one or more respective cord. Within this embodiment, the beads are retained from sliding movement by the fabric attachment through which the cord passes. To prevent fabric failure that could allow bead movement, it is preferred that the fabric employed within this embodiment be a perforated cloth containing periodic high-tensile strength abrasion resistant fibers. Additional inner and outer layers of material may be attached to the beaded matrix 250 as in the other embodiments described.

Figure 14:
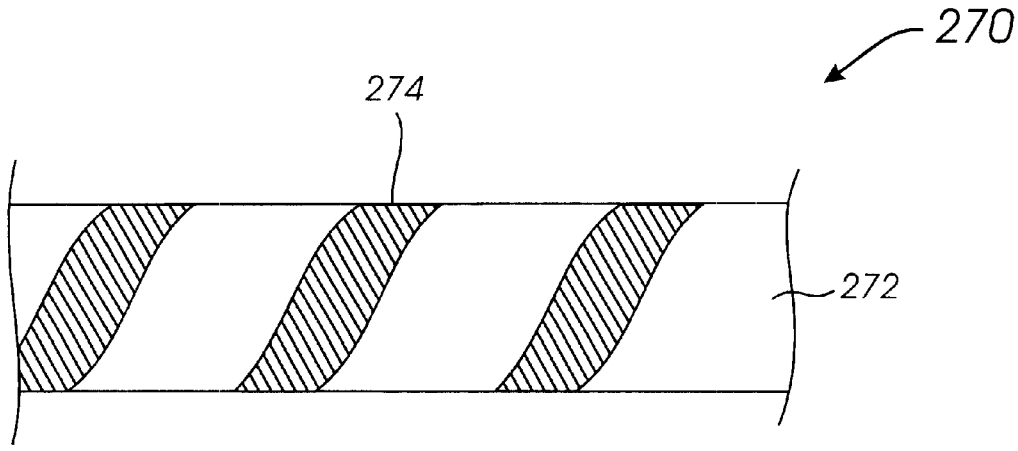
FIG. 14 is a detailed view of an embodiment of abrasion resistant cord showing belts of Kevlar surrounding a central material core which preferably contains elastic.

FIG. 14 exemplifies a single cord of material 270 for use within the corded matrix, and comprises a central core 272 which preferably has a high strength fibrous material into which is incorporated elastic strands, and exterior high-abrasion resistant strands of material, such as Kevlar™, to prevent the cord from wearing through during an abrasive incident.

Figure 15:
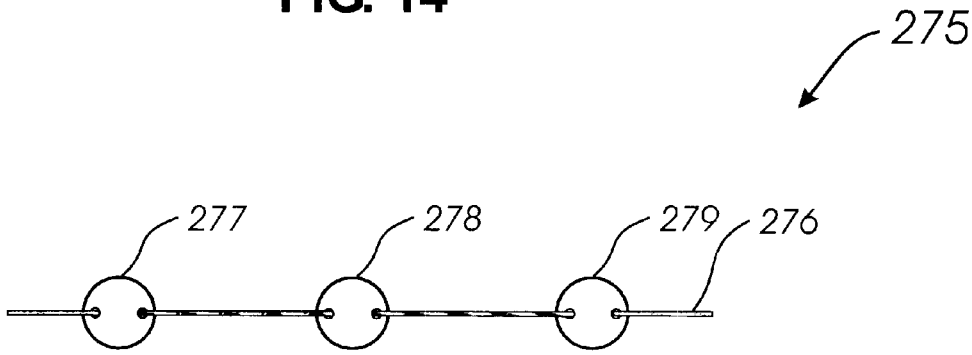
FIG. 15 is a side view of a portion of the beaded matrix according to the invention which is shown utilizing beads of varying sizes.

Referring to FIG. 15 is shown a portion of a beaded matrix 275, wherein the cord matrix 276 retains beads 277, 278, and 279 which are variously sized according to the area of application about the exterior of the body. It will be appreciated that areas of low abrasion risk may be spanned by the cord matrix which is configured without beads.

Figure 16:
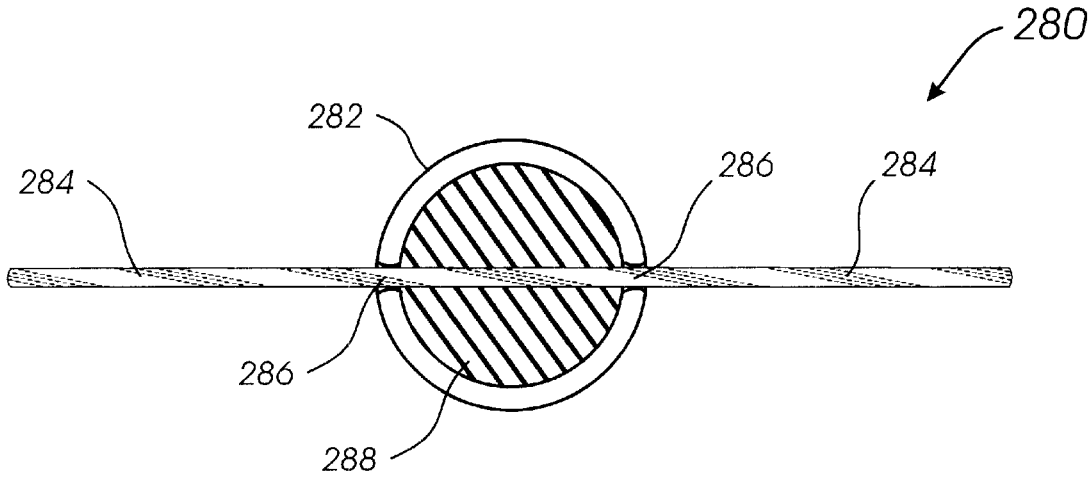
FIG. 16 is a cross-section of an abrasion resistant bead according to an embodiment of the present invention, shown having an interior filled with a light material.
Figure 17:
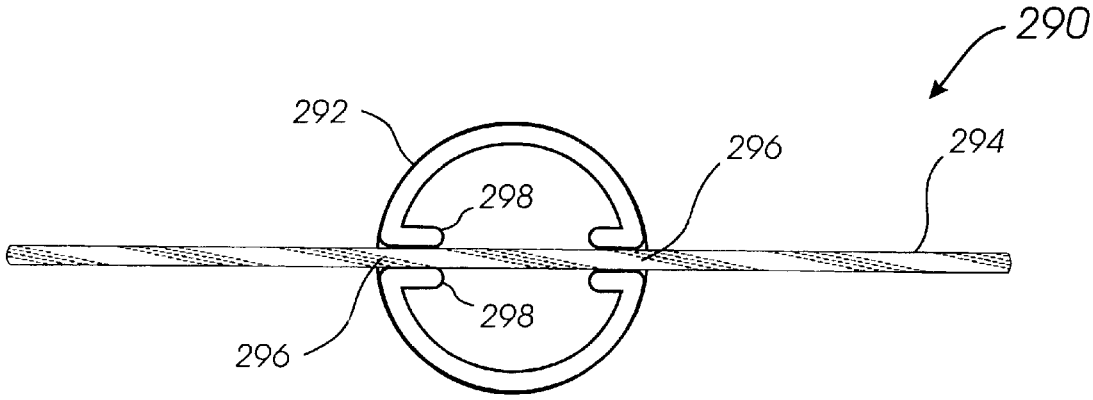
FIG. 17 is a cross-section of an abrasion resistant bead according to an embodiment of the present invention, shown having an exterior shell configured with expanded cord apertures.
Figure 18:
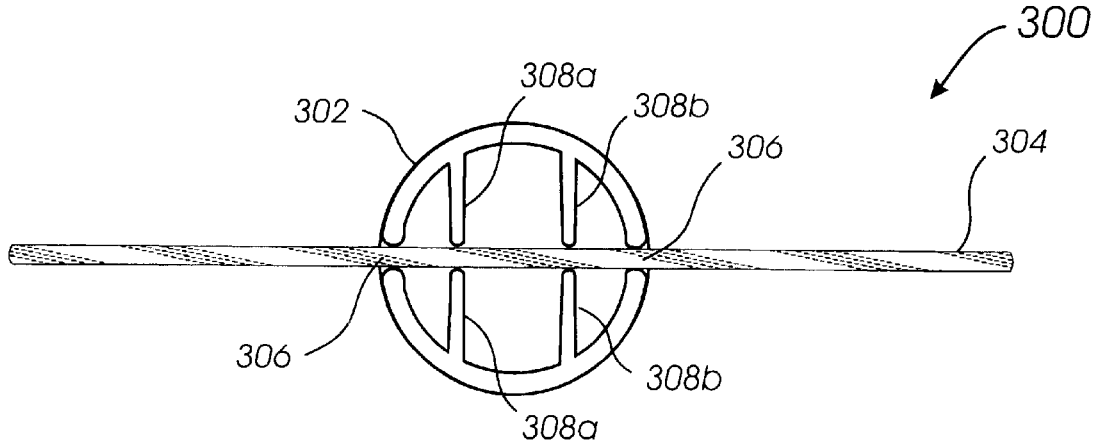
FIG. 18 is a cross-section of an abrasion resistant bead according to an embodiment of the present invention, shown having interior structures to improve rigidity.

Referring now to FIG. 16 through FIG. 18, it will be appreciated that the beads within the matrix may be manufactured in numerous configurations, so long as the bead provides an abrasion resistant exterior. FIG. 16 is a beaded matrix portion 280, having a bead 282 on a cord 284 passing though the bead at openings 286. The bead 282 in this example is filled with a light weight material 288 capable of enhancing cord retention within the bead shell. FIG. 17 is a beaded matrix portion 290 having a bead 292 on a cord 294, wherein openings 296 within bead 292 are configured with rounded edge expanded cord apertures 298 while the interior of bead 292 is hollow. The use of rounded edges at the interface between the cord and bead is generally preferred for all bead configurations, as acute edges of the bead at the interface may otherwise abrade the cord proximal the interface. However, the introduction of the rounded edges may complicate manufacture, whereby a larger cord diameter with additional abrasion resisted may be opted for. FIG. 18 is a beaded matrix portion 300 wherein a bead 302 is attached to a cord fiber 304 and has openings 306. The bead 302 contains interior structures 308*a*, 308*b* for increasing the exterior rigidity of bead 302.

Figure 19:
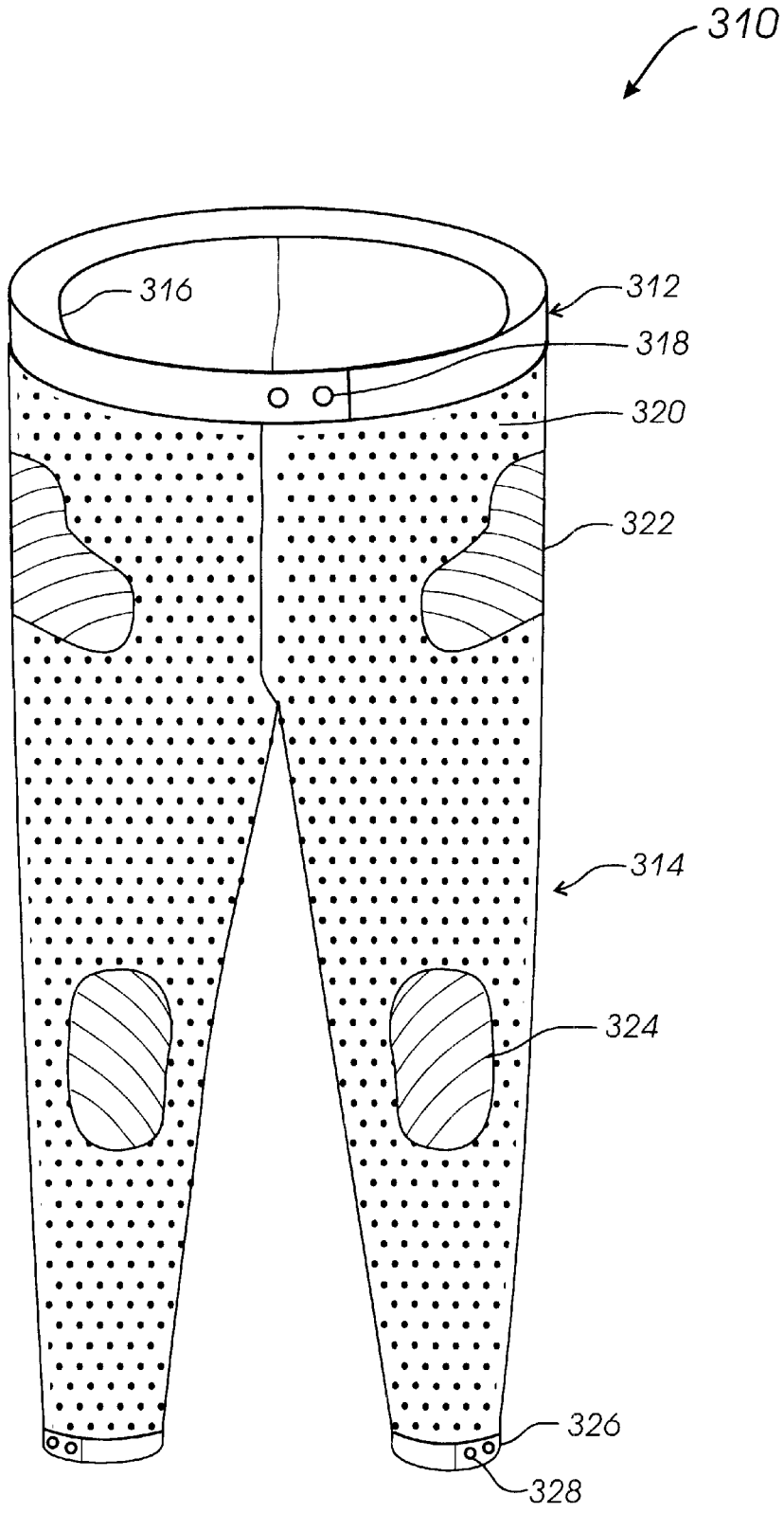
FIG. 19 is a front view of an example trouser garment constructed from the abrasion-resistant beaded matrix shown with included body armor sections.

Referring finally to FIG. 19 is exemplified a completed trouser garment 310 which incorporates an embodiment of the beaded matrix according to the invention. The trouser has a waistband 312 from which leg portions 314 extend. The waistband comprises a horizontal loop of material 316 secured in a closed position by a fastener 318. The portions of the leg 314 are covered by a combination of beaded matrix 320 upon which are attached impact resistant body armor at strategic locations, such as at sections 322 (over the hip bone) and 324 (over the knee joint) as shown. The lower portion of the garment terminating at the ankle is configured with a band 326 which is securely retained in a closed position by a fastener 328, such that the material matrix may not egress from the ankle area upon the application of force during sliding. It will be further appreciated that the beaded matrix of the present invention may be utilized over more limited regions within a garment as to provide for air-flow without the loss of abrasion resistance.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A garment material for use within abrasion resistant clothing, comprising:

a plurality of beads of an abrasion resistant material having rounded exteriors; and a matrix of cords interconnecting said beads and configured for retaining said beads in a two-dimensional pattern as a material from which abrasion resistant clothing may be fabricated.

2. A garment material as recited in claim 1, wherein said matrix of cords comprise material of sufficiently high tensile strength to prevent said beads from disconnecting from said matrix of cords in response to sliding contact with a roadway surface.

3. A garment material as recited in claim 1, wherein said matrix of cords are attached to said plurality of beads through a material portion of each of said beads.

4. A garment material as recited in claim 1, wherein at least the exterior portions of said beads comprise an abrasion resistant material having a coefficient of friction sufficiently low as to reduce inducing rotational torque forces on a wearer of said garment in response to sliding contact with a roadway surface that can lead to additional tumbling injuries.

5. A garment material as recited in claim 4, wherein the exterior of said bead comprises a UHMW polyethylene material.

6. A garment material as recited in claim 1, wherein said beads are attached to said matrix of cords and configured to partially rotate in response to a frictional force being applied to the exterior of said beads, thereby applying a tension force to said cords which tightens the matrix of cords within the garment material upon the wearer.

7. A garment for providing abrasion protection, comprising:

a plurality of beads; and a two-dimensional matrix of retention cords attached through each of said plurality of beads; and a shell of said garment having material configured to conform to body portions of a wearer and incorporating said plurality of beads and said crossing matrix of retention cords.

8. A garment as recited in claim 7, wherein said matrix of retention cords within said garment is configured to tighten in response to tension being applied to said retention cords as said plurality of beads are urged to rotate in response to abrasive contact.

9. A garment as recited in claim 7, wherein each of said plurality of beads is retained by at least two of said retention cords which pass through said bead along separate paths.

10. A garment as recited in claim 9, wherein said plurality of beads are periodically located over the two-dimensional matrix of said retention cords.

11. A garment as recited in claim 9, wherein said separate paths comprise a crossing pattern.

12. A garment as recited in claim 11, wherein said beads are located at the crossings of said retention cord.

13. A garment as recited in claim 7, wherein said two-dimensional matrix of said retention cords provides a cord matrix having a predetermined geometry.

14. A garment as recited in claim 13, wherein the predetermined geometry is selected from the group of matrix geometries consisting of triangular, square, hexagonal, and octagonal.

15. A garment as recited in claim 7, wherein said retention cords are fabricated from a material of sufficiently high tensile strength to prevent said beads from disconnecting from said matrix of said retention cords in response to abrasive contact.

16. A garment as recited in claim 15, wherein said retention cords incorporate materials selected from the group of high-tensile strength materials consisting of aramid fibers, carbon fibers, and combinations of said fibers thereof.

17. A garment as recited in claim 7, further comprising integral elastic material within said retention cords so that the matrix of retention cords within the garment conform to the shape of the wearer.

18. A garment as recited in claim 7, further comprising means of preventing the ends of said garment, through which a portion of wearers body protrudes, from moving to expose additional portions of wearers skin to abrasion.

19. A garment as recited in claim 7, further comprising one or more additional layers of material within said garment to provide thermal control and visual enhancement within said garment.

20. A garment as recited in claim 19, wherein the exterior of said garment incorporates reflective materials to enhance visibility.

21. A garment as recited in claim 7, further comprising shock absorbing materials incorporated within said garment at locations for the protection of underlying boney areas.

22. A garment as recited in claim 21, wherein said shock absorbing materials comprise sections of body armor.

23. A garment as recited in claim 7, wherein said beads are free from exterior edges which may catch the ground and rotate under sufficient abrasive force to tear said garment or to be driven through the skin of the person wearing said garment.

24. A garment as recited in claim 7, wherein said beads are formed having a substantially smooth exterior wherein the abrasion force under frictional load remains substantially constant as the angle of rotation of said bead changes.

25. A garment as recited in claim 24, wherein said beads are generally of a spherical shape.

26. A garment as recited in claim 24, wherein said beads are generally of an oval shape.

27. A garment as recited in claim 7, wherein the exterior of said beads comprises polyethylene.

28. A garment as recited in claim 27, wherein said polyethylene an ultra-high molecular weight (UHMW) polyethylene.

29. A garment as recited in claim 7, wherein each of said beads may be formed from a single material.

30. A garment as recited in claim 7, wherein the interior of said beads may comprise a lighter weight material than the exterior of said beads, or said beads may be substantially hollow.

31. A garment as recited in claim 7, wherein said beads are approximately 5 mm in diameter and wherein the spacing between said beads on said garment is approximately 20 mm.

32. A garment as recited in claim 7, wherein said shell of said garment incorporates said plurality of beads and said two-dimensional matrix of retention cords in selected portions of said shell of said garment.

33. A garment as recited in claim 10, further comprising at least one band configured for retention in a closed position by a fastener, within said shell of said garment, to prevent movement of said shell that would expose additional body areas to abrasion.

34. A garment as recited in claim 7, wherein said garment comprises a torso-protection jacket.

35. A garment as recited in claim 7, wherein said garment comprises a lower-body protection set of trousers.

* * * * *